US008797174B2

(12) United States Patent
Chen

(10) Patent No.: US 8,797,174 B2
(45) Date of Patent: Aug. 5, 2014

(54) EXTENSION CORD WITH ENVIRONMENTAL CONDITION SENSING ABILITY

(75) Inventor: Yu-Gang Chen, Yongkang (TW)

(73) Assignee: Far East University, Tainan County (TW)

( * ) Notice: Subject to any disclaimer, the term of this patent is extended or adjusted under 35 U.S.C. 154(b) by 407 days.

(21) Appl. No.: 12/413,624

(22) Filed: Mar. 30, 2009

(65) Prior Publication Data

US 2009/0243847 A1 Oct. 1, 2009

(30) Foreign Application Priority Data

Mar. 28, 2008 (TW) ..... 97111469 A

(51) Int. Cl.
*G08B 21/00* (2006.01)

(52) U.S. Cl.
USPC ..... 340/654; 340/628; 340/573.1; 439/188; 439/652; 439/535; 439/638; 361/115

(58) Field of Classification Search
USPC ..... 340/540, 654, 628–629, 630, 631, 632, 340/573.1; 62/196.4; 361/41, 115, 116; 219/491, 494, 497, 501, 504, 505, 507, 219/511, 519; 337/113, 300, 380, 112; 700/292; 439/188, 652, 682, 502, 535, 439/638
See application file for complete search history.

(56) References Cited

U.S. PATENT DOCUMENTS

| | | | | |
|---|---|---|---|---|
| 4,514,729 | A * | 4/1985 | Szarka | 340/3.4 |
| 5,708,554 | A * | 1/1998 | Liner | 361/104 |
| 7,961,111 | B2 * | 6/2011 | Tinaphong et al. | 340/638 |
| 2005/0007709 | A1 * | 1/2005 | Wright | 361/43 |
| 2007/0006603 | A1 * | 1/2007 | Reusche et al. | 62/196.4 |
| 2007/0038334 | A1 * | 2/2007 | Chou et al. | 700/292 |
| 2007/0297112 | A1 * | 12/2007 | Gilbert | 361/91.5 |
| 2008/0094210 | A1 * | 4/2008 | Paradiso et al. | 340/540 |

* cited by examiner

*Primary Examiner* — Hoi Lau
(74) *Attorney, Agent, or Firm* — Ming Chow; Sinorica, LLC

(57) ABSTRACT

An extension cord with environmental condition sensing ability has a plug for connecting to a power source, and includes a main body, a sensor unit, and a current control unit. On the main body, there are provided a first socket group and a second socket group, which are electrically connected to the power source via the plug. The sensor unit is electrically connected to the second socket group for sensing an environmental condition and thereby generating a signal. The current control unit and the sensor unit together form an electric circuit, and the current control unit receives the signal generated by the sensor unit and turns on or cuts off electric current being supplied to the second socket group according to the received signal.

11 Claims, 2 Drawing Sheets

EXTENSION CORD WITH ENVIRONMENTAL CONDITION SENSING ABILITY

FIELD OF THE INVENTION

The present invention relates to an extension cord with environmental condition sensing ability, and more particularly to an extension cord that is able to sense an environmental condition to thereby turn on or cut off electric current being supplied thereto.

BACKGROUND OF THE INVENTION

There are a large number of various electric appliances available for use in people's daily life now. Since every one of these electric appliances has a plug for electrically connecting to a power source, the number of power receptacles available in a general house tends to be insufficient for these electric appliances to plug in. Therefore, one or more extension cords are frequently used to provide increased number of power receptacles.

There is developed a smart-type power control device, which is quite expensive and usually arranged in an advanced electric appliance or a computer. Moreover, the smart-type power control device and other peripheral electronic devices can not be synchronously controlled conveniently.

The conventional extension cords are very popular among people for using in daily life, but they only provide a power supply function and a basic switch function.

It is therefore tried by the inventor to develop an extension cord with environmental condition sensing ability to improve the smart-type power control device and the conventional extension cords.

SUMMARY OF THE INVENTION

A primary object of the present invention is to provide an extension cord with environmental condition sensing ability to overcome the problems in the conventional extension cords.

To achieve the above and other objects, the extension cord with environmental condition sensing ability according to the present invention has a plug for connecting to a power source, and includes a main body, a sensor unit, and a current control unit. On the main body, there are provided a first socket group and a second socket group, which are electrically connected to the power source via the plug. The sensor unit is electrically connected to the second socket group and adapted to sense an environmental condition to thereby generate a signal. The current control unit and the sensor unit together form an electric circuit, and the current control unit receives the signal generated by the sensor unit to thereby turn on or cut off electric current being supplied to the second socket group.

BRIEF DESCRIPTION OF THE DRAWINGS

The structure and the technical means adopted by the present invention to achieve the above and other objects can be best understood by referring to the following detailed description of the preferred embodiments and the accompanying drawing, wherein.

DETAILED DESCRIPTION OF THE PREFERRED EMBODIMENTS

Figure 1:
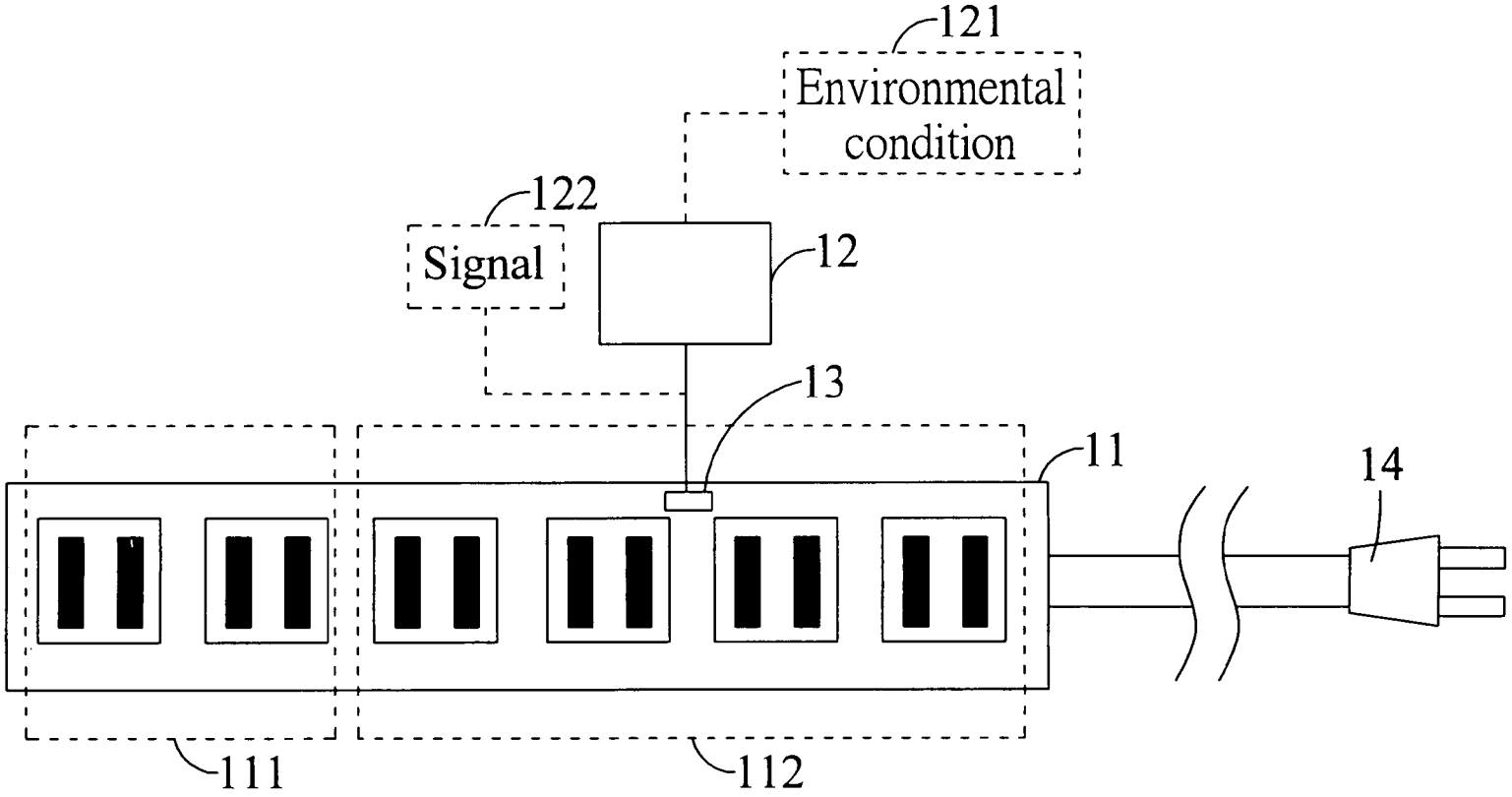
FIG. 1 is a conceptual view of an extension cord with environmental condition sensing ability according to an embodiment of the present invention.

The present invention will now be described with some preferred embodiments thereof. For the purpose of easy to understand, elements that are the same in the preferred embodiments are denoted by the same reference numerals.

Please refer to FIG. 1 that is a conceptual view of an extension cord with environmental condition sensing ability according to an embodiment of the present invention. As shown, the extension cord of the present invention has a plug 14 for connecting to a power source and includes a main body 11, a sensor unit 12, and a current control unit 13. On the main body 11, there are provided a first socket group 111 and a second socket group 112. The first and the second socket group 111, 112 are electrically connected to the power source via the plug 14. The first and the second socket group 111, 112 each internally include a plurality of conducting terminals, which are electrically connected to the plug 14. The sensor unit 12 is electrically connected to the second socket group 112 and adapted to sense an environmental condition 121 and thereby generates a signal 122. The sensor unit 12 can include a light sensor, a supersonic wave sensor, and a temperature sensor that are elements with sensing ability. The environmental condition 121 can be any one of a light condition, a supersonic wave reflection condition, and a temperature condition. The sensor unit 12 can be wirelessly connected to the current control unit 13. Alternatively, the sensor unit 12 can be connected to the current control unit 13 in a wired manner. The sensor unit 12 can further include a wireless transmitter for transmitting a wireless signal to the current control unit 13, and the current control unit 13 can further include a wireless receiver for receiving the wireless signal from the sensor unit 12. The current control unit 13 and the sensor unit 12 together form an electric circuit, and the current control unit 13 can turn on or cut off electric current being supplied to the second socket group 112 according to the signal 122 received from the sensor unit 12. In the present invention, the current control unit 13 can be a switch circuit.

More specifically, the sensor unit 12 is electrically connected to the main body 11 of the extension cord in a wired or a wireless manner to locate outside the main body 11 of the extension cord for transmitting a signal to the current control unit 13. Alternatively, the sensor unit 12 can be provided inside the main body 11 of the extension cord to reduce an overall volume of the extension cord.

With the above arrangements, electronic devices that must be constantly supplied with electric power for synchronized control can be plugged in the first socket group 111, and electronic devices that require control through the sensor unit 12 can be plugged in the second socket group 112. The electronic devices can be any one of a computer screen, a fan, a louder speaker, a desk lamp, etc. The sensor unit 12 can detect whether a user is present before some electronic devices through light sensing and/or temperature sensing. When it is detected that the user is not present before the electronic devices, the sensor unit 12 can generate the signal 122 to the current control unit 13, so that the current control unit 13 receiving the signal 122 controls the second socket group 112 to stop supplying electric power. For example, when the sensor unit 12 detects a lowered temperature or re-detects light when a shadow disappears, the sensor unit 12 determines that the user has left his or her seat and thereby generates the signal 122 to control the current control unit 13 to cut off the electric power being supplied to the second socket group 112, so that electric current is no longer supplied to the electronic devices plugged in the second socket group 112 to achieve the purpose of electric energy saving.

Figure 2:
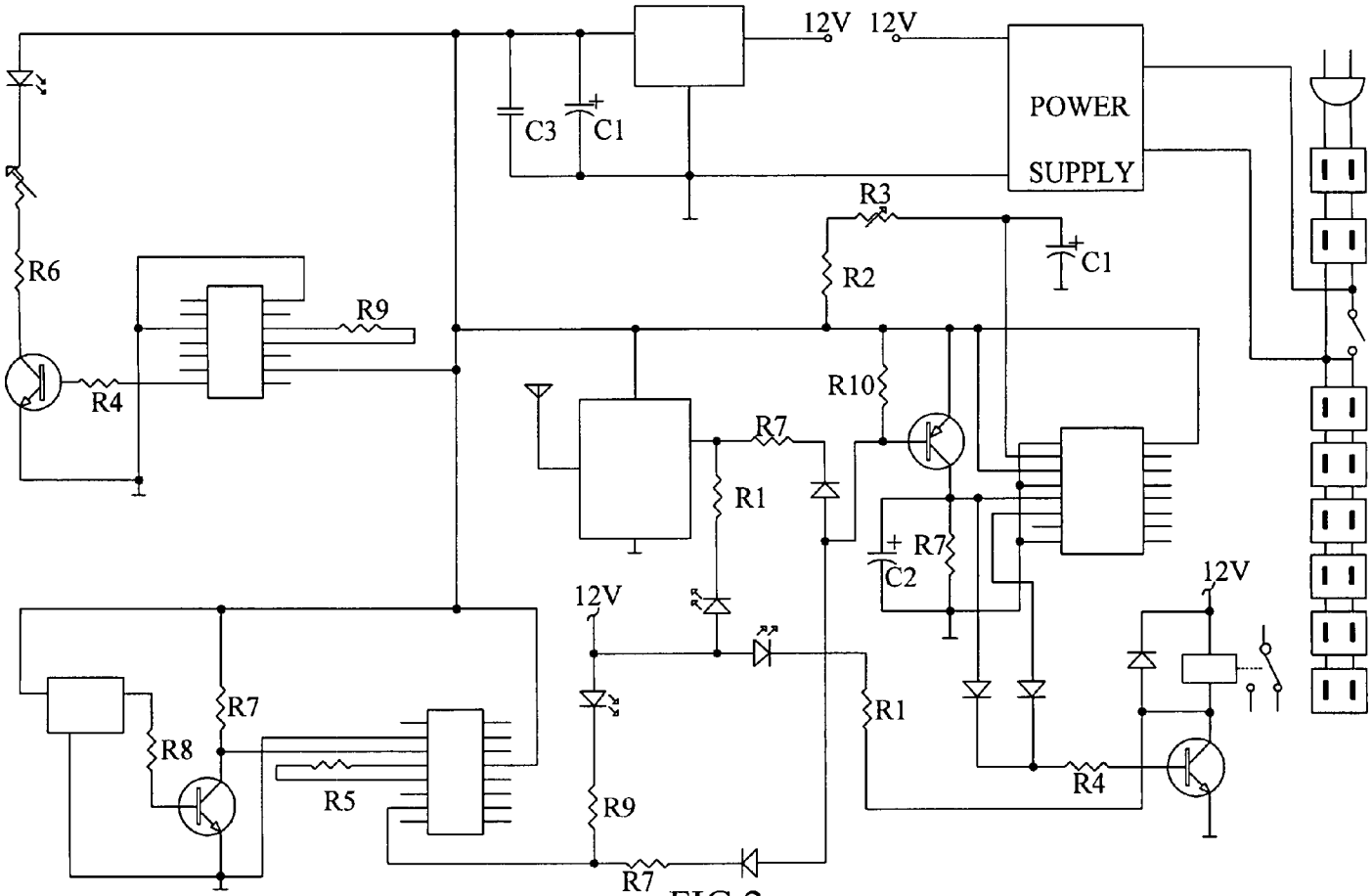
FIG. 2 is a conceptual view of an extension cord with environmental condition sensing ability according to electric circuit of the present invention.

Please refer to FIG. 2 that is a conceptual view of an extension cord with environmental condition sensing ability according to electric circuit of the present invention. As shown, the extension cord of the present invention has a plug for connecting to a power source and includes a main body 11, a sensor unit 12, and a current control unit 13. The sensor unit 12 can be wirelessly connected to the current control unit 13. Alternatively, the sensor unit 12 can be connected to the current control unit 13 in a wired manner. The sensor unit 12 can further include a wireless transmitter for transmitting a wireless signal to the current control unit 13, and the current control unit 13 can further include a wireless receiver for receiving the wireless signal from the sensor unit 12. The current control unit 13 and the sensor unit 12 together form an electric circuit, and the current control unit 13 can turn on or cut off electric current being supplied to the second socket group 112 according to the signal 122 received from the sensor unit 12. In the present invention, the current control unit 13 can be a switch circuit. Sensor unit 12 having at least one light-emitting diodes provided thereon, which indicate the on/off status of power 18 being electrically connected to the first socket group 111 and the second socket group 112. The sensor unit 12 also includes a sensor chip 15 for sensing the environmental condition.

The sensor unit 12 includes a control chip 16, which being electrically connected to the wireless transmitter 17 and the sensor chip 15. The control chip 16 to determine the values of the environmental condition, which is detected by the sensor unit 12 to turn off the power if necessary.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An extension cord with environmental condition sensing ability and having a plug for connecting to a power source, comprising:

a main body, including:

a first socket group, provided on the main body for connecting of a first electronic device, wherein the first socket group is permanently directly electrically connected to the power source via the plug such that the first electronic device is constantly supplied with electric current; and a second socket group, provided on the main body for connecting of a second electronic device, wherein the second socket group is selectively electrically connected to the power source via the plug such that the second electronic device is selectively supplied with electric current;

a current control unit, turning on or cutting off electric current being supplied to the second socket group for controlling the second socket group being electrically connected to the power source or not; and a sensor unit, connected to the current control unit to form an electric circuit together and disposed near the second electronic device to sense whether a user is present near the second electronic device or not by determining values of environmental condition and thereby generating a signal, wherein the environmental condition is a light condition, a supersonic wave reflection condition, or a temperature condition, while the value of the temperature condition is lower or intensity value of the light condition is increase, the sensor unit senses the user is not present;

wherein, if the sensor unit senses the user is present, the current control unit turns on the electric current being supplied to the second socket group by the signal generated from the sensor unit, such that both the first socket group and the second socket group are supplied with the electric current; and if the sensor unit senses the user is not present, the current control unit cuts off the electric current being supplied to the second socket group by another signal generated from the sensor unit, such that only the second socket group is not supplied with the electric current, while the first socket group is supplied with the electric current regardless of the user is present or not.

2. The extension cord with environmental condition sensing ability as claimed in claim 1, wherein the sensor unit is connected to the current control unit in a wired manner.

3. The extension cord with environmental condition sensing ability as claimed in claim 1, wherein the sensor unit is connected to the current control unit in a wireless manner.

4. The extension cord with environmental condition sensing ability as claimed in claim 1, wherein the first socket group and the second socket group internally include a plurality of conducting terminals.

5. The extension cord with environmental condition sensing ability as claimed in claim 1, wherein the current control unit is a switch circuit.

6. The extension cord with environmental condition sensing ability as claimed in claim 1, wherein the sensor unit is connected to the main body of the extension cord in a wired manner to transmit the signal to the current control unit.

7. The extension cord with environmental condition sensing ability as claimed in claim 1, wherein the sensor unit is located inside the main body of the extension cord.

8. The extension cord with environmental condition sensing ability as claimed in claim 1, wherein the sensor unit is connected to the main body of the extension cord in a wireless manner to transmit the signal to the current control unit.

9. The extension cord with environmental condition sensing ability as claimed in claim 1, wherein the sensor unit includes a wireless transmitter for transmitting a wireless signal to the current control unit.

10. The extension cord with environmental condition sensing ability as claimed in claim 9, wherein the current control unit includes a wireless receiver for receiving the wireless signal from the sensor unit.

11. The extension cord with environmental condition sensing ability as claimed in claim 1, wherein the sensor unit includes a sensor chip for sensing the environmental condition.

* * * * *